United States Patent [19]

Scherrer et al.

[11] 4,081,082

[45] Mar. 28, 1978

[54] COUPLER SHANK HARD FACING

[75] Inventors: Charles L. Scherrer; Don L. Baughman, both of Pittsburgh, Pa.

[73] Assignee: McConway & Torley Corporation, Pittsburgh, Pa.

[21] Appl. No.: 743,948

[22] Filed: Nov. 22, 1976

[51] Int. Cl.[2] ..... B61G 1/38

[52] U.S. Cl. ..... 213/62 A; 308/239

[58] Field of Search ..... 213/20, 21, 60, 61, 213/62 R, 62 A, 63–65, 67, 69, 72; 308/DIG. 8, 239; 29/149.5 R

[56] References Cited

U.S. PATENT DOCUMENTS

| | | | |
|---|---|---|---|
| 1,344,184 | 6/1920 | Milliken | 213/62 R |
| 1,964,647 | 6/1934 | Pike et al. | 29/149.5 R |
| 2,821,010 | 1/1958 | Vasconi et al. | 29/149.5 R |
| 3,589,529 | 6/1971 | Altherr | 213/62 A |

*Primary Examiner*—Trygve M. Blix
*Assistant Examiner*—Stuart M. Goldstein
*Attorney, Agent, or Firm*—Thomas H. Murray

[57] ABSTRACT

A hard-facing deposit of weld metal in the form of parallel, spaced-apart tracks extends along the external bottom wall of a railroad coupler shank for engagement with the working face surface of a coupler carrier. The tracks of weld metal are arranged longitudinally within the shank area located, in part, between the horn line and connector opening in the coupler shank. The weld metal is usually ¼-inch or less in thickness, 1-inch wide with a 1-inch space between the track deposits of weld metal.

4 Claims, 3 Drawing Figures

COUPLER SHANK HARD FACING

BACKGROUND OF THE INVENTION

This invention relates to railroad couplers and, more particularly, to a hard-facing deposit of weld material upon the bottom wall of a coupler shank to eliminate the need and disadvantages associated with wear plates fastened onto the coupler shank.

The most common type of railroad coupler is a Type E railroad coupler having a horizontal key passed through a slotted opening in the side walls of the coupler. Other known forms of couplers include an F-type and an E/F-type wherein a vertical pin is passed through an opening in the shank of the coupler. There are many variations to these known forms of couplers but each such coupler is associated with a coupler carrier that engages the shank portion of the coupler member. The cast steel construction of the coupler shank is extremely vulnerable to wear due to impact and abrasion at the area where the coupler shank contacts the usual coupler carrier or carrier wear plate. These known forms of couplers are presently provided with a wear plate having a hardness within the range of 341–415 Brinell Hardness Number. The wear plate is attached to the shank of the coupler by beads of weld at the side edges of the plate. In E/F and E-type couplers, the carrier is stationary while in F-type couplers, the carrier is resiliently supported by springs.

The use of a wear plate on coupler shanks to protect them in service has proven to be highly unsatisfactory. The wear plates on a large number of coupler shanks wear out within 1–3 years of service time. As the thickness of the wear plate is reduced in excess of one-half of its original thickness, the plate cracks and breaks into two or more pieces because of severe impact loading. These pieces of wear plate break loose from the coupler shank and fall onto the track roadbed whereby the coupler shank is left unprotected and the wear on the cast steel material thereof is extremely rapid. Furthermore, the use of wear plates is unsatisfactory because a relatively large number of wear plates comes loose from the coupler shank and is lost either due to a failure of the plate material at the edges along the weld beads or a failure of the welds. The coupler shanks are again left unprotected and wear to the point of condemning limit whereby failure can occur.

SUMMARY OF THE INVENTION

It is an object of the present invention to eliminate the need for wear plates on coupler shanks for railroad couplers as well as the attendant potential for wear plate failure and loss in service.

It is another object of the present invention to provide a more positive and durable wearing medium to protect a coupler shank of a railroad coupler against service wear and against possible coupler failure and the attendant train derailment stemming therefrom.

It is still another object of the present invention to provide a positive bonding of a protective medium onto the parent metal of a coupler shank for both new coupler members as well as for restoring existing coupler members.

More particularly, the present invention provides an improvement for a railroad coupler shank having a bottom wall directed toward a coupler carrier, which improvement comprises a hard-facing deposit of weld metal upon the bottom wall of the railroad coupler shank defining a wear-resistant shank support surface adapted to engage the coupler carrier.

The aforesaid hard-facing deposit preferably consists of spaced-apart tracks of weld metal. The tracks are preferably spaced apart and parallel longitudinally with one another such that each track has a width of about 1-inch and a thickness of ¼-inch or less. A further characteristic of the weld metal forming the hard-facing deposit includes arranging the deposits within the carrier engagement area lying between the horn line and connector opening in a coupler shank with the deposits extending in a direction parallel to the extended length of the railroad coupler shank. One form of suitable weld metal is cobalt-chromium-tungsten alloy which provides a hardness of about C-54 Rockwell C scale.

These features and advantages of the present invention as well as others will be more fully understood when the following description is read in light of the accompanying drawings, in which.

Figure 1:
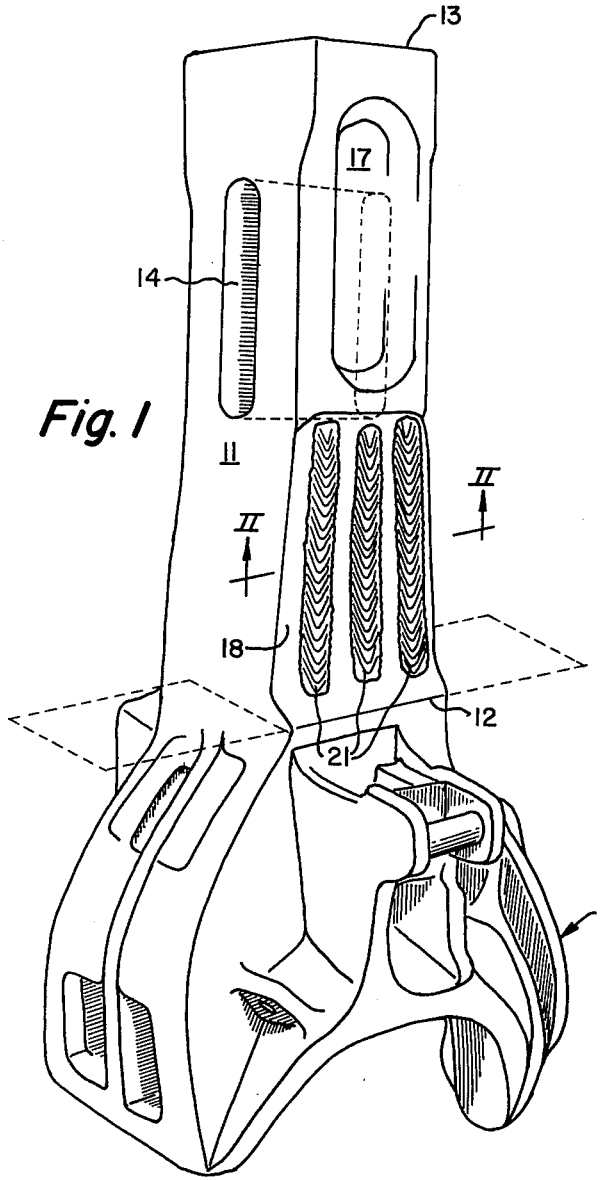
FIG. 1 is a view, in perspective, of a railroad coupler incorporating the features of the present invention.
Figure 2:
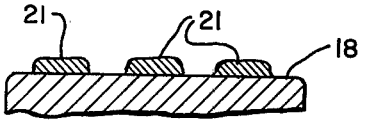
FIG. 2 is a sectional view taken along line II—II of FIG. 1.
Figure 3:
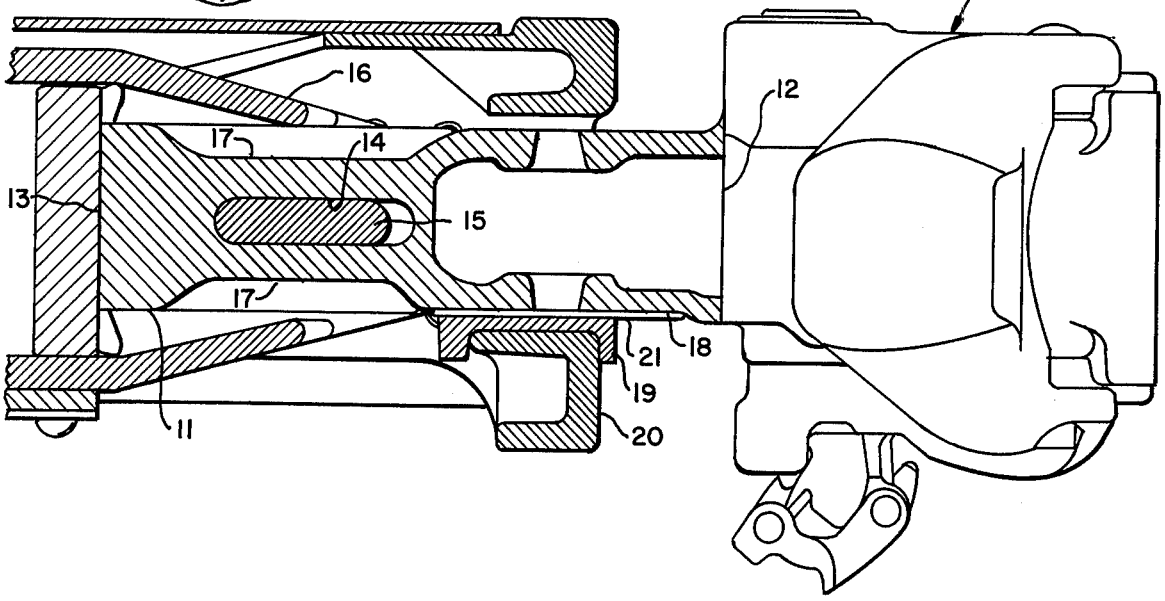
FIG. 3 is an elevational view, partly in section, of a standard type railroad E-coupler.

As shown in FIGS. 1 and 3 of the drawings, a standard type railroad E-coupler includes a coupler head 10 constructed in a manner per se known in the art. The coupler head is joined to a coupler shank 11 along a conventionally-defined horn line 12. The coupler shank terminates at a butt end 13. A key slot 14 is formed through each side wall of the coupler shank for receiving a key 15 extending horizontally through the slot and into yoke members 16 (FIG. 3). The top and bottom walls of the coupler shank adjacent the butt end thereof include elongated depressions 17 used as relief areas in the casting. A shank plate recess 18 is also formed in the bottom wall of the coupler shank and bounded between the horn line 12 and the depression 17. The shank plate recess is oriented to overlie a coupler carrier wear plate 19 that is, in turn, carried by the usual striking casting 20 forming part of the draft assembly.

The parts thus far described relate to a standard E-type coupler; however it will be understood that the features and advantages of the present invention are applicable to other known types of coupler arrangements including, but not limited to, locomotive couplers and freight car couplers particularly an F-type coupler and a coupler with an F-shank wherein a shank engagement surface overlies a coupler carrier that is, in turn, supported by carrier springs in the case of the F-head, F-shank type coupler but not with the E-head, F-shank type coupler. In accordance with the present invention, the shank carrier engagement area 18 which, as is the usual practice in cast steel structures, defines a somewhat irregular cast surface. Extending along the shank carrier engagement area are three, or more, tracks or beads 21 of a hard-facing deposit of weld metal. These beads extend in a direction parallel with the elongation of the coupler shank. The width of the deposit of weld material is typically 1-inch wide and the spacing between the parallel tracks of weld material is preferably 1-inch. The weld material is usually formed with a thickness of at least ⅛-inch and depending upon the particular shank casting, the hard-facing deposit may have a thickness of ¼-inch. The weld metal is preferably cobalt-chromium-tungsten alloy to provide a hardness of about C-54 Rockwell C scale. The weld deposit is preferably formed by using a continuous wire-fed welding machine, although other known welding methods may be used to apply the hard-facing material including oxyacetylene gas, shield-metal arc, submerged arc, atomic hydrogen shielded arc and inert-gas-shield arc. Stick-welding electrodes may be used in place of a continuous wire-fed welding process.

The C-54 Rockwell scale hardness of the hard-facing deposit of the weld metal corresponds to 534 Brinell Hardness Number and offers far superior wear properties than is usually obtained with a wear plate. Other weld materials offering ductility along with strength and high resistance to abrasion and impact will provide a hardness of about 444 Brinell Hardness Number and are suitable for the weld metal.

In light of the foregoing, it will be apparent that the use of a hard-facing weld metal on the shank carrier engagement area in place of the conventional wear plate eliminates the need for such wear plates and the attendant potential for the loss in service of the wear plates. The weld metal affords a more positive and durable wearing medium for protection against wear and possible coupler failure and the possible consequences of a train derailment. Existing coupler shanks can be protected with the hard-facing deposit of weld metal in the field and in the event it is necessary to restore the hard-facing weld metal, this can be readily accomplished. By using weld metal, a more positive bond to the coupler shank is utilized which alleviates the need to carry out expensive grinding operations to obtain a flat surface in the shank recess as has been the usual practice for attaching a wear plate thereon. The weld material of the present invention can be applied to the bottom wall of the coupler shank notwithstanding a convex configuration thereof or even small lumps of material thereon which heretofore produced cracking of the welds used to attach wear plates thereto. The wear plates frequently broke in service as a result of impact loading upon an unsupported plate central area of a shank surface that was concave to any extent in excess of 1/16 of an inch. It is no longer necessary to assure a relatively smooth flat surface for contact with the face surface of a coupler carrier.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. In a railway coupler including a shank having a bottom wall facing a coupler carrier, the improvement comprising a wear-resistant shank surface consisting of a hard-facing deposit of weld metal upon said bottom wall for engaging said coupler carrier, said weld metal being the only bearing surface engaging said coupler carrier and comprising parallel tracks of weld metal each having a thickness of at least 1/8 inch and extending between the horn line and connector opening of said coupler shank, the weld metal comprising a cobalt-chromium-tungsten alloy and having a hardness of at least Rockwell C54.

2. The improvement according to claim 1 wherein said tracks of weld metal have a thickness of ¼-inch or less.

3. The improvement according to claim 1 wherein said tracks of weld metal each has a width of about 1-inch.

4. The improvement according to claim 1 wherein said hard-facing deposit extends in a direction parallel to the extended length of said railroad coupler shank.

* * * * *